US007749034B2

(12) United States Patent
Oz et al.

(10) Patent No.: US 7,749,034 B2
(45) Date of Patent: Jul. 6, 2010

(54) ERGONOMIC PEDALING APPARATUS

(75) Inventors: Oren Oz, Modiin (IL); Yael Debby, Mevaseret Tazion (IL)

(73) Assignee: Nuvo Group Ltd., Modiin (IL)

( * ) Notice: Subject to any disclaimer, the term of this patent is extended or adjusted under 35 U.S.C. 154(b) by 0 days.

(21) Appl. No.: 12/488,648

(22) Filed: Jun. 22, 2009

(65) Prior Publication Data

US 2009/0258550 A1 Oct. 15, 2009

Related U.S. Application Data

(63) Continuation-in-part of application No. 11/775,267, filed on Jul. 10, 2007, now abandoned.

(60) Provisional application No. 60/929,069, filed on Jun. 12, 2007.

(51) Int. Cl.
*B63H 16/20* (2006.01)

(52) U.S. Cl. ..... 440/27

(58) Field of Classification Search ..... 440/17, 440/19, 20, 26–31, 90; 472/128
See application file for complete search history.

(56) References Cited

U.S. PATENT DOCUMENTS

| | | | | |
|---|---|---|---|---|
| 1,411,540 A | | 4/1922 | Szafka | |
| 1,728,103 A | * | 9/1929 | Chaligne | 114/283 |
| 2,317,905 A | | 4/1943 | Galgin | |
| 2,976,835 A | | 3/1961 | Germick | |
| 3,180,306 A | | 4/1965 | Gouedy | |
| 3,640,239 A | | 2/1972 | Petroskey | |
| 3,874,319 A | | 4/1975 | Martin et al. | |
| 3,999,501 A | | 12/1976 | Duarte | |
| 4,037,557 A | * | 7/1977 | Arevalo | 114/283 |
| 4,241,688 A | | 12/1980 | Mansolill | |

(Continued)

FOREIGN PATENT DOCUMENTS

| | | |
|---|---|---|
| EP | 0531260 | 3/1993 |

(Continued)

OTHER PUBLICATIONS

International Search Report mailed Jan. 7, 2009, for PCT/IL2008/00796.

(Continued)

*Primary Examiner*—Edwin Swinehart
(74) *Attorney, Agent, or Firm*—Mark M. Friedman

(57) ABSTRACT

An ergonomic pedaling apparatus for travel in water, enabling a user to practice swimming skills, comprising: an ergonomic supporting body for supporting the upper part of the user's body when frontally mounted over the body, where the body includes a curved triangular structure having three vertices constructed by three connected chassis members; three floatation units each connected to a separate vertex of the body; and a pedaling assembly comprising two scooped pedals enabling the user to progress in water by hand pedaling the pedals. The floatation units include: a first and a second back floatation units each comprising a float, where the floatability of the back floatation units is substantially equal and a third front floatation unit comprising two float parts vertically positioned one on top of the other. The floatability of the combined floats of the third floatation unit may be substantially equal to the floatability of each of the back floatation units.

17 Claims, 9 Drawing Sheets

U.S. PATENT DOCUMENTS

| | | | |
|---|---|---|---|
| 4,500,297 | A | 2/1985 | Boulva |
| 4,698,033 | A | 10/1987 | Hall |
| 4,828,522 | A | 5/1989 | Santos |
| 7,097,521 | B1 | 8/2006 | Papadakis |

FOREIGN PATENT DOCUMENTS

| | | |
|---|---|---|
| GB | 2272412 | 5/1994 |
| GR | 1003078 | 2/1999 |

OTHER PUBLICATIONS

Written Opinion of the International Searching Authority mailed Jan. 7, 2009, for PCT/IL2008/00796.

* cited by examiner

ERGONOMIC PEDALING APPARATUS

CROSS REFERENCE TO RELATED APPLICATION

This application is a Continuation In Part (CIP) Application of U.S. application Ser. No. 11/775,267, filed Jul. 10, 2007, which is incorporated herein by reference in its entirety, which in turn claimed the benefit of U.S. Provisional Patent Application 60/929,069, filed Jun. 12, 2007, which is further incorporated herein by reference in its entirety.

BACKGROUND

1. Field of the Invention

The present invention relates generally to the field of pedaling apparatuses and more particularly to pedaling apparatuses for traveling in water.

2. Related Art

Pedaling apparatuses for travel in water usually allow a user to use his legs for pedaling pedals which are usually operatively associated with a propeller enabling to propel the apparatus through the water.

To teach swimming using an apparatus that can travel in water the apparatus needs to be designed in such a manner that allows the user, who is practicing his/her swimming skills, to simulate as closely as possible the swimming body movements while using the apparatus, while providing the user, whose swimming skills are not yet perfected, with the outmost security and support. Unfortunately, available apparatuses and watercrafts do not provide such benefits.

A patent no. GR1003078 discloses a surface craft with controllable displacement. The craft is composed of a propulsion system and a flattened hull in the shape of an isosceles triangle supported by three floats which are of variable displacement and placed on the top of the triangular arrangement. The triangular body of the system is connected to the floats via proper arrangements, and can be kept at a desired height from the sea surface by balancing the height alteration caused by the displacement change.

The floats of the craft level the triangle to be substantially parallel to the water level and therefore forces the user to propel the craft in a standing or a sitting position, since the flattened shape of the triangle makes it quite difficult to lay the front upper part of the user's body (the user's torso and head) against the triangle. The craft does not include any pedals and therefore requires some other instrument for propelling the craft in water such as oars.

A patent application no. EP0531260 (A1) discloses a watercraft having three floating bodies connected to a tubular frame part. The front floating body is provided with a pivotable handlebar for steering. The tubes are releasably inserted into sockets. A propeller is driven by means of a pedal crank via a transmission. The tubular frame can be dismantled and the floating bodies folded up so that the watercraft only takes up a little space when not in use. In this craft the pedals are only used for operating the propeller for propelling the watercraft, where the user is required to pedal the pedals using his feet while being positioned in a sitting posture. This posture does not simulate the swimming movements of a swimmer and therefore the watercraft cannot be used for practicing swimming.

Another U.S. Pat. No. 4,037,557 discloses a hand-driven water craft having a narrow main hull portion cooperating with a submerged ballast member for the support of a flat deck partially overlying the hull and partially extending rearwardly therefrom as a cantilever. The hull supports a hand crank propeller assembly for imparting forward propulsion to the craft, and the rear portion of the deck supporting a rudder adapted to be engaged by the feet of an operator lying in a prone position atop the deck.

Although this craft allows hand-driving by pedals, the deck is flat thereby making it difficult if not impossible for the user to lie upon the deck for pedaling, requiring the user to drive the craft by sitting on the deck. therefore, this craft is not suitable for practicing swimming skills.

SUMMARY

According to one aspect of the invention, there is provided an ergonomic pedaling apparatus for travel in water, enabling a user to practice swimming skills. The ergonomic pedaling apparatus may comprise:

- an ergonomic supporting body having a curved triangular structure creating three vertices, wherein the triangular structure includes a curved triangular chassis constructed by three connected chassis members, wherein the supporting body enables supporting the upper part of the user's body when frontally mounted over the chassis;
- three floatation units each connected to a separate vertex of the body; and
- a pedaling assembly comprising two scooped ergonomic pedals enabling the user to progress in the water by pedaling the pedals, where the scooped shape of each pedal enables scooping water in an opposite direction to the direction of travel, wherein the three floatation units include: a first and a second back floatation units each comprising at least one float, wherein the floatability of the back floatation units is substantially equal and a third front floatation unit comprising at least two float parts vertically positioned one on top of the other.

The distances between the two back floatation units and the third floatation unit may be designed to allow the user to place the abdominal part of the user's body between the back floatation units, where the head of the user is positioned above the third floatation unit. The pedaling assembly may be located underneath the third floatation unit for allowing hand pedaling of the apparatus.

The floatability of the combined floats of the third floatation unit may be substantially equal to the floatability of each of the back floatation units.

According to another aspect of the invention, there is provided an ergonomic pedaling apparatus for travel in water, enabling a user to practice swimming skills. The ergonomic pedaling apparatus may comprise:

- an ergonomic supporting body having a curved triangular structure creating three vertices, wherein the triangular structure includes:
  - a curved triangular chassis constructed by three connected chassis members, wherein the supporting body enables supporting the upper part of the user's body when frontally mounted over the chassis;
  - a first angular removable connector and a second removable connector having at least two outlets enabling to connect one of the chassis members to the floats of the back floatation units and each of the back floatation units to one of the floats of the third floatation unit by receiving each end of the chassis members in each outlet; and
  - a third angular removable connector having at least three outlets enabling to receive two of the chassis members at two of the outlets to connect to the back floatation units;

three floatation units each connected to a separate vertex of the body, wherein the three floatation units include: a first and a second back floatation units each comprising one float of the same shape size and floatability and a third front floatation unit comprising two floats vertically connected to one another;

a pedaling assembly comprising two scooped ergonomic pedals enabling the user to progress in the water by pedaling the pedals, where the scooped shape of each pedal enables scooping water in an opposite direction to the direction of travel;

an elongated member enabling to connect to a first float of the third floatation unit through the third outlet of the third angular removable connector at one end of the elongated member and to a second float of the third floatation unit at another end; and pedals connecting mechanism enabling to connect the scooped pedals to the second float of the third floatation unit.

The floatability of the first and second back floatation units may be substantially equal.

The removable connectors connecting the chassis members to the floatation units may enable forming the triangular ergonomic structure of the supporting body while connecting at least some of the floats of the floatation units in a removable manner, creating a modular ergonomic pedaling apparatus enabling to define the size of the supporting body and the floatability of each of the floats in the floatation units according to a desired configuration by enabling to replace the chassis members and the floats.

The distances between the two back floatation units and the third floatation unit are designed to allow the user to place the abdominal part of the user's body between the back floatation units, where the head of the user is positioned above the third floatation unit.

The pedaling assembly may be located underneath the third floatation unit for allowing hand pedaling of the apparatus.

The floatability of the combined two floats of the third floatation unit may be substantially equal to the floatability of each of the back floatation units, where the division and positioning of the floats of the third floatation unit enables slightly lifting the head area of the user when the user mounts his/her weight upon the apparatus for traveling in water.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings, wherein.

DESCRIPTION

Figure 1:
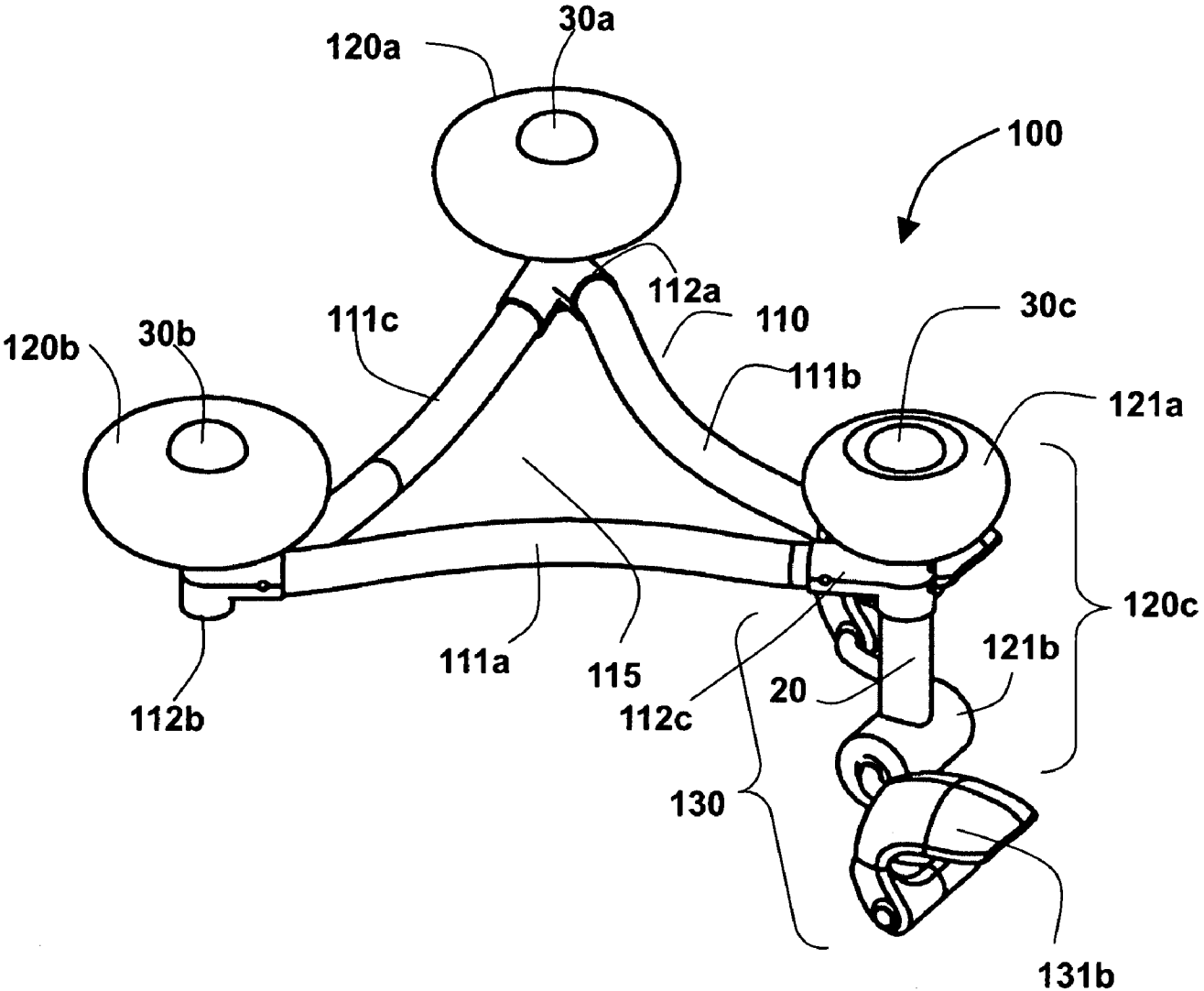
FIG. 1 is a schematic illustration of an isometric view of an ergonomic pedaling apparatus, according to some embodiments of the invention.

Reference will now be made in detail to embodiments of the present invention, examples of which are illustrated in the accompanying drawings, wherein like reference numerals refer to the like elements throughout. The embodiments are described below to explain the present invention by referring to the figures.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiments, but not necessarily all embodiments, of the inventions. It is understood that the phraseology and terminology employed herein is not to be construed as limiting and are for descriptive purpose only.

The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers. The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks. The term "method" refers to manners, means, techniques and procedures for accomplishing a given task including, but not limited to, those manners, means, techniques and procedures either known to, or readily developed from known manners, means, techniques and procedures by practitioners of the art to which the invention belongs. The descriptions, examples, methods and materials presented in the claims and the specification are not to be construed as limiting but rather as illustrative only.

Meanings of technical and scientific terms used herein are to be commonly understood as to which the invention belongs, unless otherwise defined. The present invention can be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

The present invention, in some embodiments thereof, provides an ergonomic pedaling apparatus, for enabling a user to travel in water. The ergonomic pedaling apparatus is configured to allow a user to pedal with his/her hands to propel the apparatus and the user thereby in the water.

The ergonomic pedaling apparatus may be used for training users who are learning to swim by enabling to simulate the swimming movements of the user's hands and legs while pedaling the apparatus, while still being well supported in the water. This may be especially, yet not exclusively, useful for teaching children how to swim. The ergonomic pedaling apparatus is self propelled and the user pedaling the apparatus progresses in the water by his/her own pedaling.

FIGS. 1-5 schematically illustrate an ergonomic pedaling apparatus 100 for traveling in water, according to some embodiments of the invention.

Ergonomic pedaling apparatus 100 may comprise:

an ergonomic supporting body 110;

three floatation units 120*a*, 120*b* and 120*c* each connected to a separate vertex of ergonomic supporting body 110; and a pedaling assembly 130 comprising two scooped ergonomic pedals 131*a* and 131*b* enabling the user to progress in the water by pedaling pedals 131*a* and 131*b*, where the scooped shape of each pedal enables scooping water in an opposite direction to the direction of travel.

Ergonomic supporting body 110 (also referred to hereinafter as supporting body 110) enables supporting the upper part of the user's body (his/her torso and head) when the user frontally mounts his/her torso upon supporting body 110.

The scooped shape of pedals 131*a* and 131*b* allow propelling apparatus 100 without having to connect the pedals to other propelling devices (such as a propeller) and therefore better supports the simulating of the swimming movements of the hands for practicing and acquiring swimming skills.

As illustrated in FIGS. 1-5, the floatation units may include: a first back floatation unit 120*a* comprising a float; a second back floatation unit 120*b* comprising a float substantially identical in floatability (e.g. in shape, volume, density and weight) to the float of first back floatation unit 120*a*; and a third front floatation unit 120*c* comprising at least two float parts: a first float part 121*a* and a second float part 121*b* vertically positioned one on top of the other.

Each float of first and second floatation unit 120*a* and 120*b* may have radial symmetry in relation to an axis perpendicular to the axis that passes between the floats, for example, having a spherical shape. First float part 121*a* may also have a radial symmetry similar to that of the other floats of first and second floatation units 120*a* and 120*b*.

Figure 2:
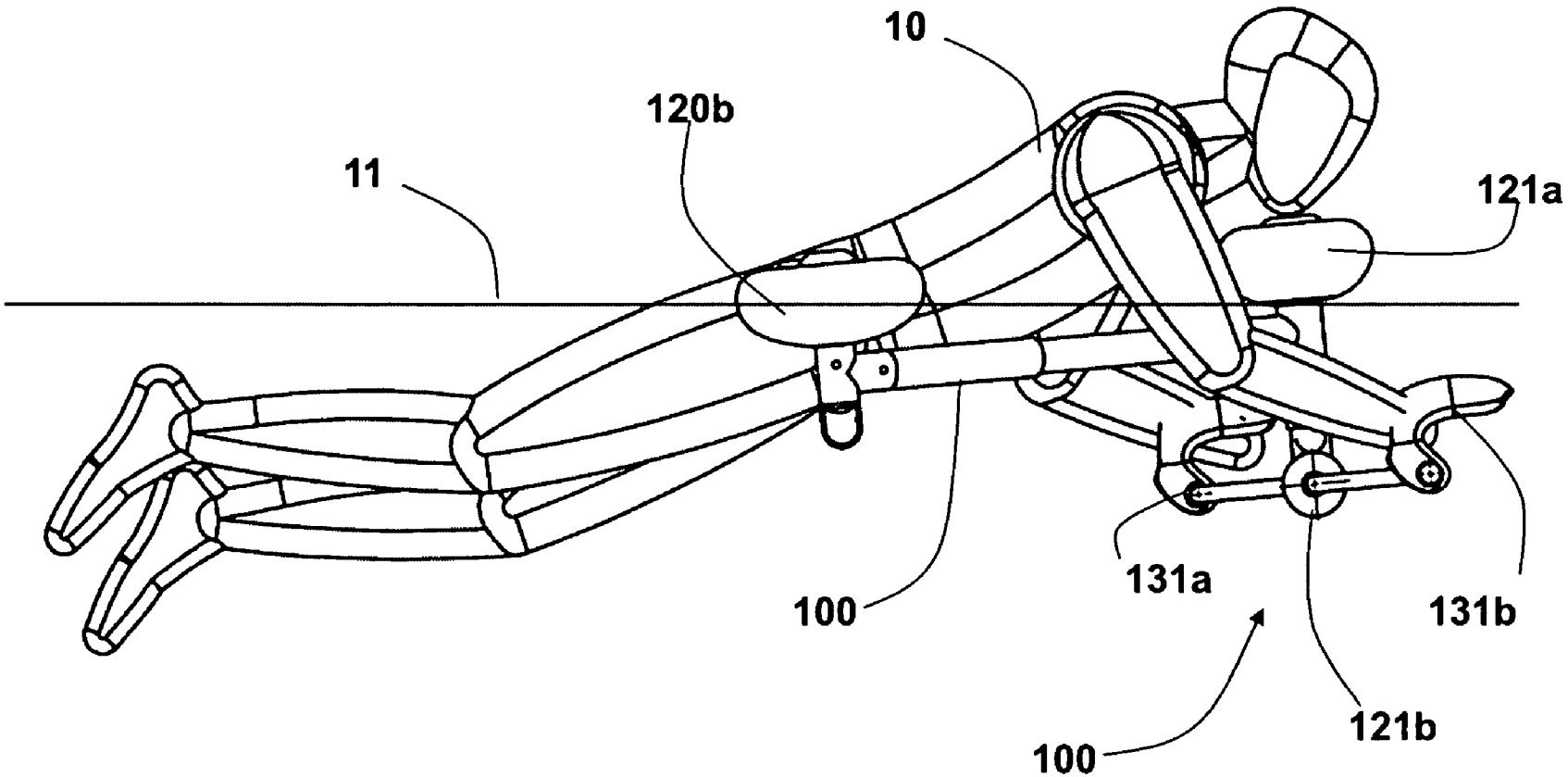
FIG. 2 is a schematic illustration of an ergonomic pedaling apparatus used by a user to travel in water, according to the embodiments illustrated in FIG. 1.
Figure 3:
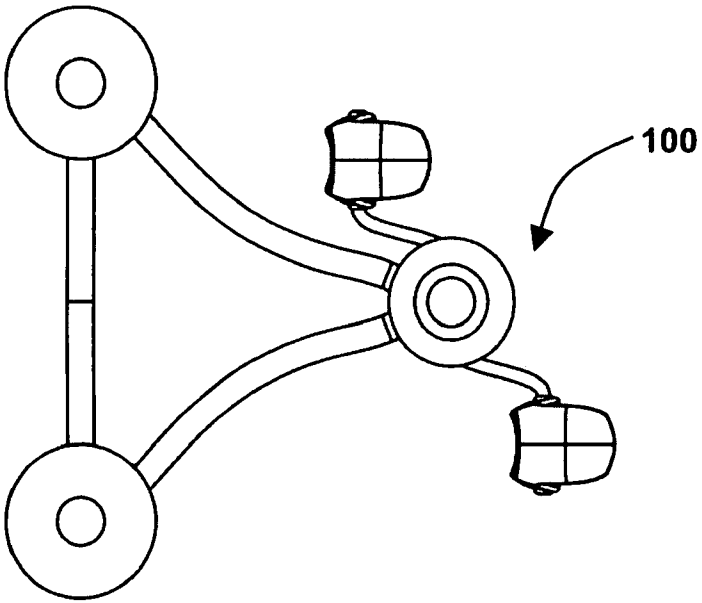
FIG. 3 is a schematic illustration of an elevated view of an ergonomic pedaling apparatus, according to the embodiments illustrated in FIGS. 1-2.

The distances between first and second back floatation units 120*a* and 120*b* and third floatation unit 120*c* are designed to allow the user to place the abdominal r part of his/her body between back floatation units 120*a* and 120*b*, where the head of the user is positioned above first float part 121*a* of third floatation unit 120*c*, as illustrated in FIG. 2.

The floatability of the combined float parts 121*a* and 121*b* of third floatation unit 120*c* may be substantially equal to the floatability of each of the back floatation units 120*a* or 120*b*. The division of third floatation unit 120*c* into two or more float parts enables slight lift of the front part of supporting body 110 to allow holding the user's head above the water when the user's weight is applied upon the apparatus, as illustrated in FIG. 2. In this way once the user's weight is mounted upon the pedaling apparatus, the lower part of the user's torso (the pelvic area) is slightly submerged below the water level 11, while the upper part of the torso is lifted upwards and emerges above the water level 11.

Floatability of an object (also known as buoyancy) is determined according to the shape, weight and volume (specific weight) and shape of the object in relation to the specific weight of the material (liquid) in which the object is placed. In this document we refer to the ability to float in a watery environment including mostly water content (such as swimming pools, fresh or sea water).

Ergonomic supporting body 110 may have a curved triangular structure creating three vertices, which is a three-dimensional geometric structure having curved contours, where the triangular structure includes a curved triangular chassis constructed by three connected curved chassis members 111*a*, 111*b* and 111*c* that intersect to create the vertices, as illustrated in FIGS. 1-5. Supporting body 110 is configured to enable supporting the user's torso when frontally mounted over the chassis, as illustrated in FIG. 2. The back chassis member 111*c* may be curved downwards to allow ergonomically supporting the user's pelvic area where the other chassis members 111*a* and 111*b* may be curved inwardly towards the center point of the triangular structure (see FIGS. 4-5).

Ergonomic supporting body 110 may further comprise a sheet 115 stretched between chassis members 111*a*, 111*b* and

111*c*, further enabling to support the user's weight when mounted upon ergonomic supporting body 110.

Sheet 115 may be made of any substantially elastic material known in the art such as a net or a fabric that can support the user's weight. Sheet 115 may be made from, for example, a shape memory material enabling to create a three dimensional contours of the parts of the user's torso that were pressed upon the sheet and temporarily maintain the configured shape.

Sheet 115 may be made form any material known in the art that allows supporting the user's weight and have a sufficient flexibility to be as comfortable as possible for the user to apply his/her torso thereupon, such as fabric, Neoprene, etc.

Chassis members 111*a*, 111*b* and 111*c* may be three dimensional curved tubes or rods that may be connected to one another in a removable manner or in a non-removable manner.

Chassis members 111*a*, 111*b* and 111*c* may be made from any solid material known in the art such as plastic or metal, where the elasticity level of chassis members 111*a*, 111*b* and 111*c* may be determined according to the manufacturer's requirements.

Pedaling assembly 130 may be located underneath third floatation unit 120*c* for allowing hand pedaling of ergonomic pedaling apparatus 100. As illustrated in FIG. 2, pedaling assembly 130 is located right under front third floatation unit 120*c* and is connected thereto, to allow the user to naturally place each of his/her hands over each pedal while his/her head is lifted by third floatation unit 120*c*.

According to embodiments, ergonomic pedaling apparatus 100 may further comprise:

a first angular removable connector 112*a* enabling to connect chassis member 111*b* to chassis member 111*c* and to the float of first back floatation unit 120*a;* a second angular removable connector 112*b* enabling to connect chassis member 111*c* to chassis member 111*a* and to the float of second back floatation unit 120*b;* a third angular removable connector 112*c* enabling to connect to first and second chassis members 111*a* and 111*b;* an elongated member 20 enabling to connect second float part 121*b* to first float part 121*a* of third floatation unit 120*c* through third angular removable connector 112*c* at one end of elongated member 20 and to second float part 121*b* of third floatation unit 120*c* at another end; and a pedals connecting mechanism of pedaling assembly 130 enabling to connect ergonomic scooped pedals 131*a* and 131*b* to second float part 121*b*, where pedaling assembly 130 includes pedals 131*a* and 131*b* and the pedals connecting mechanism.

Figure 4:
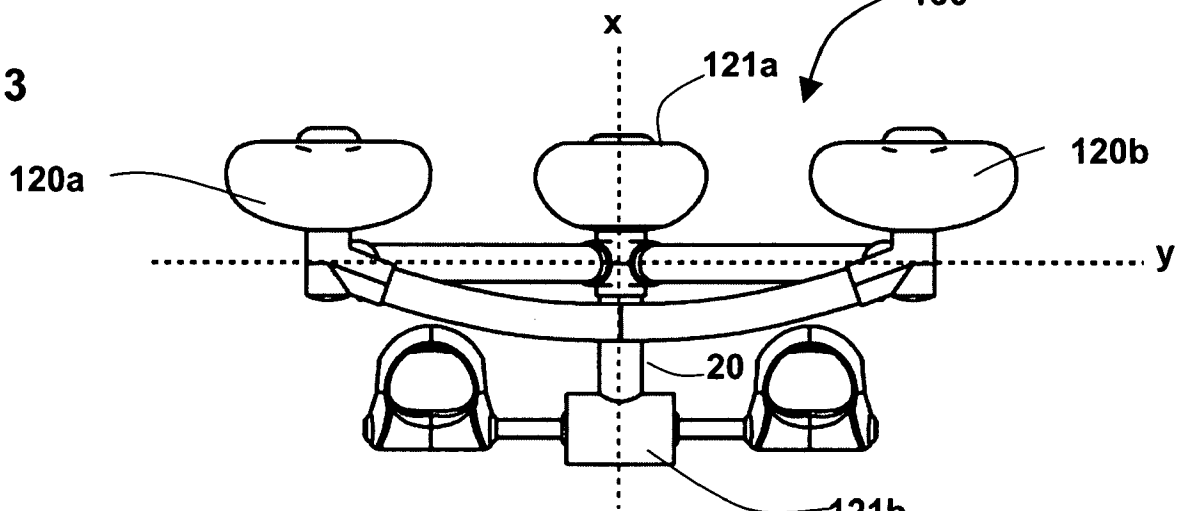
FIG. 4 is a schematic illustration of a back view of an ergonomic pedaling apparatus, according to the embodiments illustrated in FIGS. 1-3.

As illustrated in FIG. 4, each of the floats of the first and second back floatation units 120*a* and 120*b* is located along an axis "y", which is substantially perpendicular to an axis "x" connecting the float parts 121*a* and 121*b* of third floatation unit 120*c*.

Each angular connector may include outlets such as outlets 21*a*, 21*b*, 21*c* and 21*d*. Each outlet may enable receiving the connected element and fastened to it through a fastening mechanism. For example, elongated member 20 may be received by outlet 21*b* of third angular connector 112*c*; chassis member 111*a* may be received by outlet 21*d* of third angular connector 112*c*; chassis member 111*b* may be received by outlet 21*c* of third angular connector 112*c*.

Removable angular connectors 112*a*, 112*b* and 112*c* connecting chassis members 111*a*, 111*b* and 111*c* to floatation units 120*a*, 120*b* and 120*c* enable forming the triangular ergonomic structure of supporting body 110 while connecting at least some of the floats of floatation units 120*a*, 120*b* and 120*c* in a removable manner, providing a modular ergonomic pedaling apparatus 100 enabling the consumer to define the size of supporting body 100 and the floatability of each of the floats and float parts in floatation units 120*a*, 120*b* and 120*c* according to a desired configuration by enabling to replace the chassis members and the floats.

According to embodiments, as illustrated in FIGS. 1-5, pedals the connecting mechanism comprises:

second float part 121*b*, which is a hollow tube shaped float;

two pedal connectors 132*a* and 132*b* enabling to removably connect to one another, where connected pedal connectors 132*a* and 132*b* can be removably and rotatably inserted through the hollow tube of second float part 121*b*, and where each of the scooped pedals 131*a* and 131*b* is connected to a connector 132*a* and 132*b*, respectively; and channeled fasteners 133*a* and 133*b*.

Each pedal 131*a* and 131*b* may include a channeled perforation enabling to insert an edge of a pedal connector 132*a* and 132*b* respectively, there through. Channeled fasteners 133*a* and 133*bb* may be used to fasten the edge of a connector threaded into the perforation of the pedal to the pedal to prevent pedals 131*a* and 131*b* from being removed from pedal connectors 132*a* and 132*b*, respectively.

Figure 5:
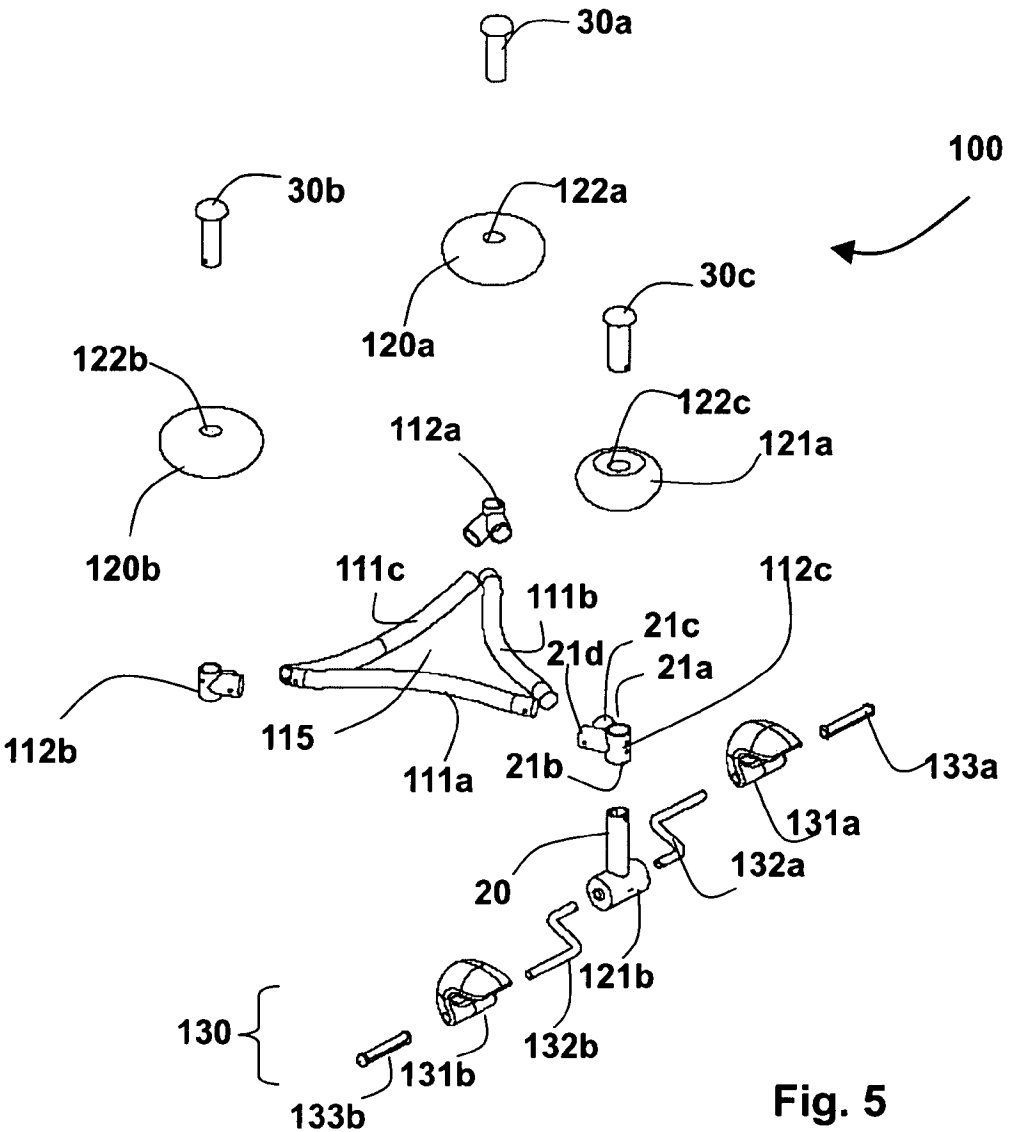
FIG. 5 is a schematic illustration of an isometric exploded view of an ergonomic pedaling apparatus, according to the embodiments illustrated in FIGS. 1-4.

The connected pedal connectors 132*a* and 132*b* may form a zigzag shape having multiple angles, as illustrated in FIG. 5.

As illustrated in FIGS. 1-5, ergonomic pedaling apparatus 100 may further comprise fastening caps 30*a*, 30*b* and 30*c* for fastening the floats and float parts of each of floatation units 120*a*, 120*b* and 120*c* to the outlet of the connecting angular connector 112*a*, 112*b* and 112*c*.

The floats of back first and second floatation units 120*a* and 120*b* and first float part 121*a* of front third floatation unit 120*c* may include a perforation 122 enabling to insert the outlet of each angular connector 112*a*, 112*b* or 112*c* through perforation 122 of each float 120*a*, 120*b* or 121*a* and covering the outlet using fastening cap 30*a*, 30*b* or 30*c*, respectively.

According to some embodiments, each of the angular connectors may be removably fastened to the fastening caps, the chassis members and/or the elongated member through a fastening mechanism.

Figure 6:
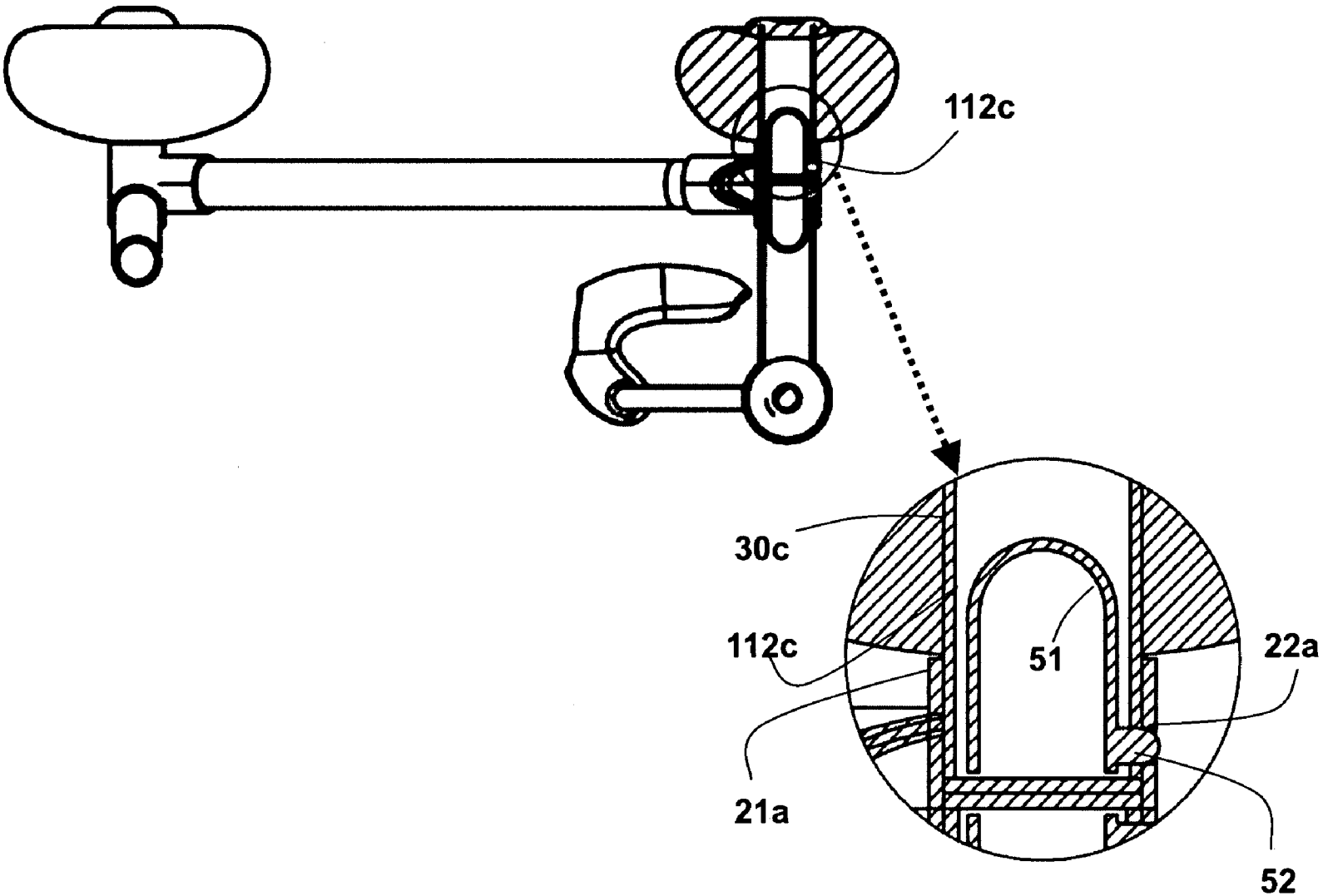
FIG. 6 is a schematic illustration of a fastening mechanism for fastening an angular connector to a fastening cap of a floatation unit of the ergonomic pedaling apparatus, according to some embodiments of the invention.

For example, as illustrated in FIG. 6, angular connector's 112*c* outlets (in this example outlet 21*a* of angular connector 112*c*) includes at least one hole 22*a*, where the inserted and fastened component (in this case fastening cap 30*c*) comprises (i) a hidden member 51 located inside the inserted component which is inserted into outlet 21*a* when cap 30*c* is inserted into outlet 21*a*, and (ii) a protrusion 52 connected to hidden member 51, enabling to be fastened by protruding from hole 22*a* of outlet 21*a* once pushed against and into outlet 21*a*, where protrusion 52 interlocks with outlet 21*a*.

Figure 7:
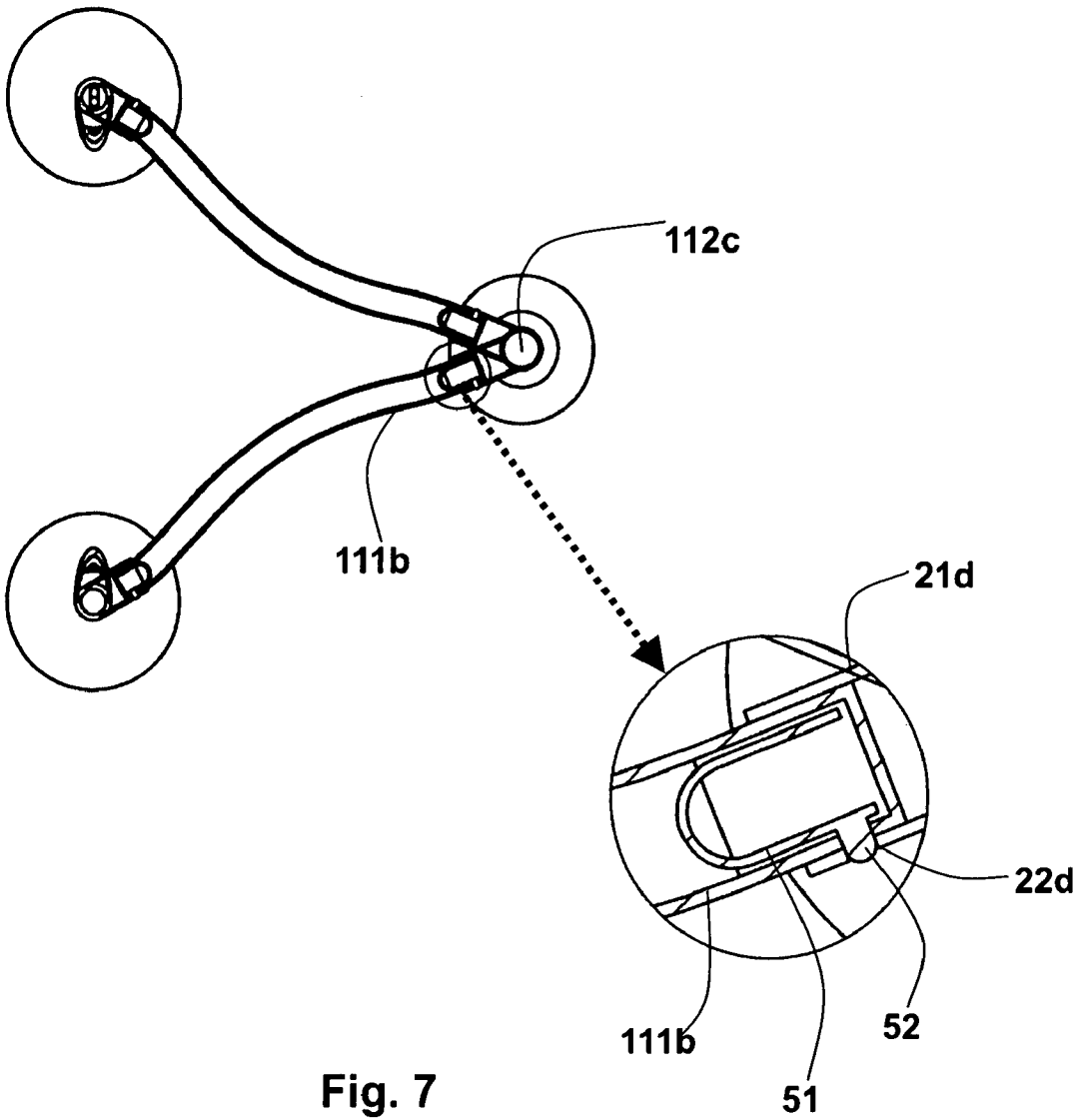
FIG. 7 is a schematic illustration of a fastening mechanism for fastening an angular connector to a chassis member of an ergonomic supporting body of the ergonomic pedaling apparatus, according to some embodiments of the invention.

FIG. 7 is a schematic illustration of a fastening mechanism for fastening outlet 21*d* of angular connector 112*c* to chassis member 111*b*, according to some embodiments of the invention. In a similar manner to the fastening mechanism described in FIG. 6, the edges of chassis member 111*a* include hidden member 51 and protrusion 52 enabling to be inserted and removed from a hole 22*d* in outlet 21*d* of angular connector 112*c* thereby being fastened thereto.

Each of hidden members 51 may have enough flexibility to allow protrusion 52 to be pressed to reduce its size in order to disconnect the two parts.

Figure 8:
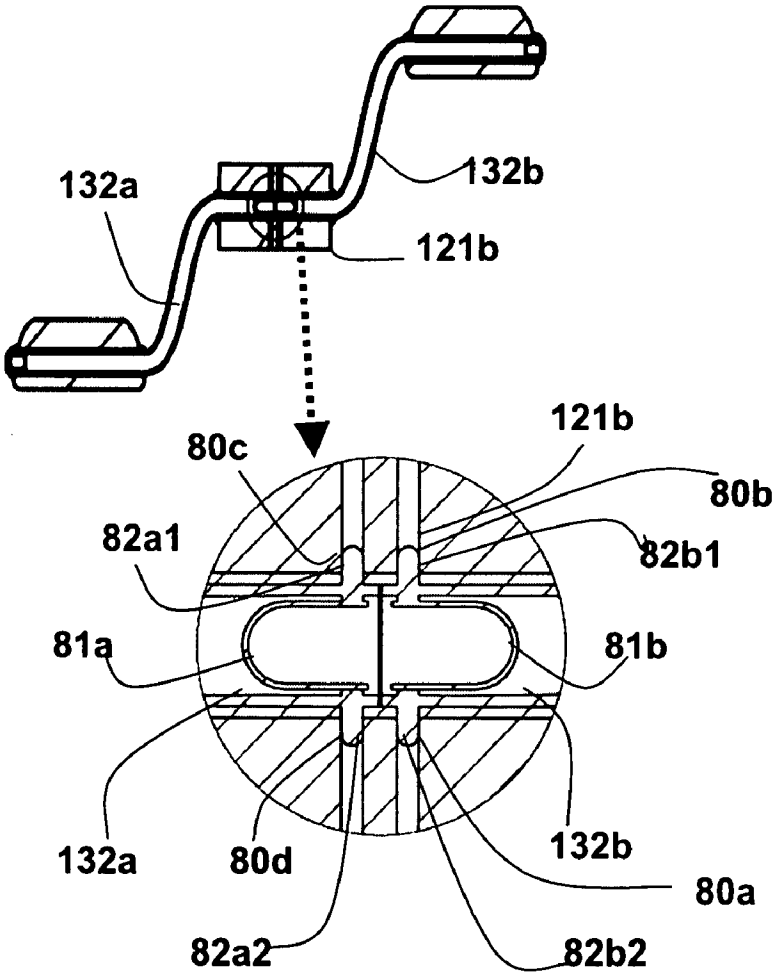
FIG. 8 is a schematic illustration of a fastening mechanism for fastening pedal connectors of the ergonomic pedaling apparatus, according to some embodiments of the invention.

FIG. 8 is a schematic illustration of a fastening mechanism for fastening pedal connectors 132*a* and 132*b* to second float part 121*b* once inserting the edge of each connector into tube shaped float part 121*b*, according to some embodiments of the invention. Second float part 121*b* may comprise four niches 80*a*, 80*b*, 80*c* and 80*d*, where each end of each of connectors

132*a* and 132*b* designed to meet one another inside second float part 121*a*, includes a hidden members and two protrusions, respectively: pedal connector 132*a* includes hidden member 81*a* and protrusions 82*a*1 and 82*a*2, where pedal connector 132*b* includes hidden member 81*b* and protrusions 82*b*1 and 82*b*2, as illustrated in FIG. 8. Niches 80*a*, 80*b*, 80*c* and 80*d* of second float part 121*a* enable receiving protrusions 82*a*1, 82*a*2, 82*b*1 and 82*b*2 to allow securing connectors 132*a* and 132*b* to second float part 121*a*. the fastening can be carried out by simply inserting each connector edge into second float part 121*a*.

Figure 9:
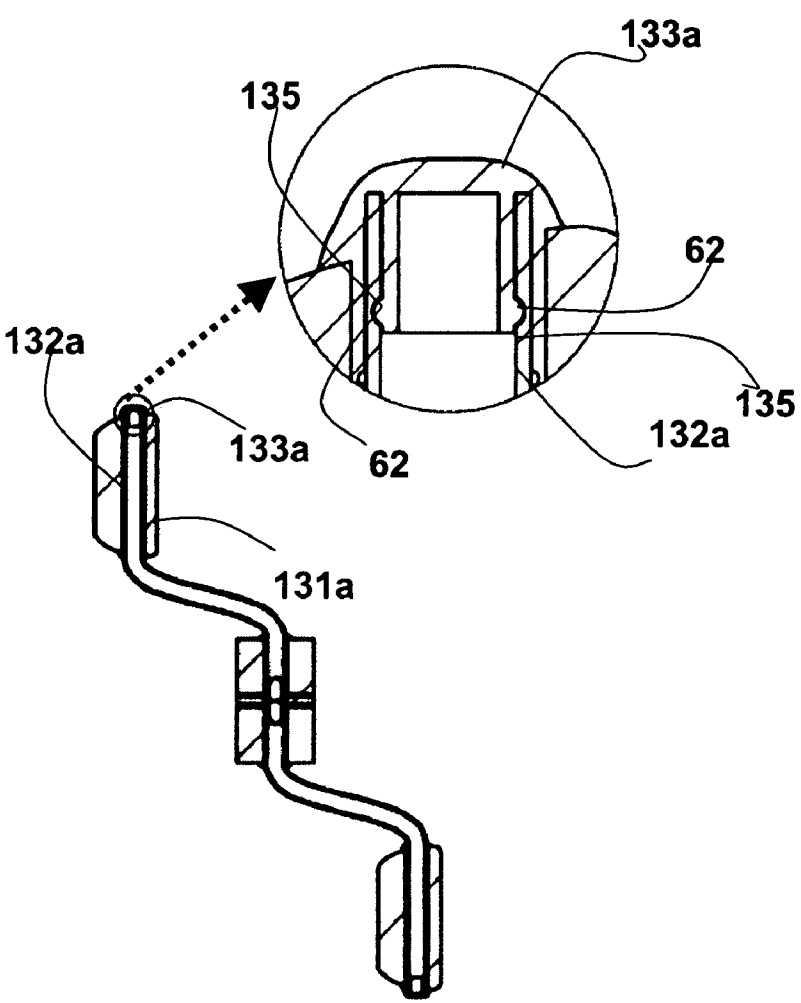
FIG. 9 is a schematic illustration of a fastening mechanism for fastening a fastener to the pedal connector of the ergonomic pedaling apparatus, according to some embodiments of the invention.

FIG. 9 is a schematic illustration of a fastening mechanism for fastening channeled fastener 133*a* to pedal connector 132*a* for securing pedal 131*a* to connector 132*a*, according to some embodiments of the invention. In this example, pedal connector 132*a* includes a circular groove 135 enabling to receive a circular protrusion 62 of channeled fastener 133*a*, thereby fastening channeled fastener 133*a* to pedal connector 132*a*.

Figure 10:
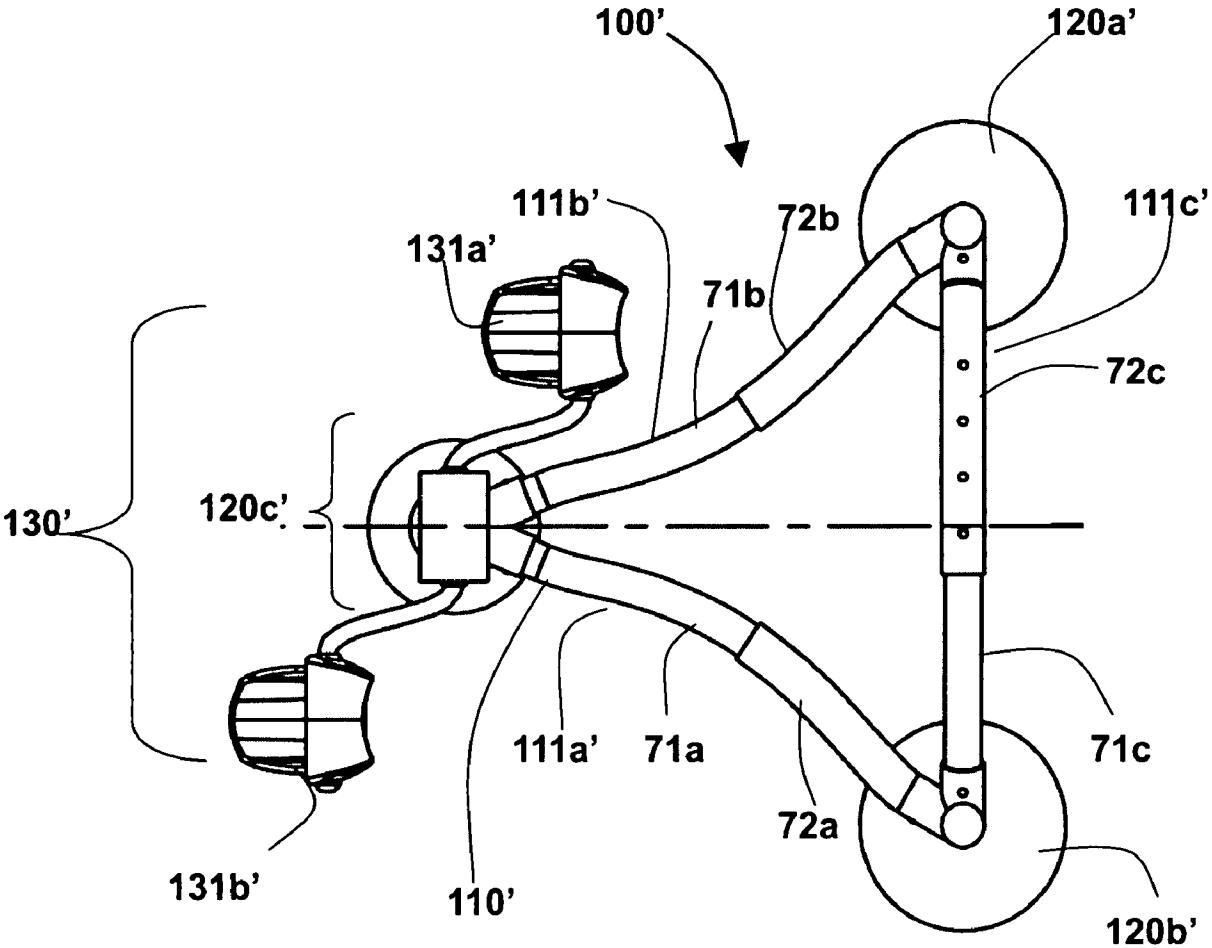
FIG. 10 is a schematic illustration of an elevated view of an adjustable ergonomic pedaling apparatus, according to other embodiments of the invention.
Figure 11:
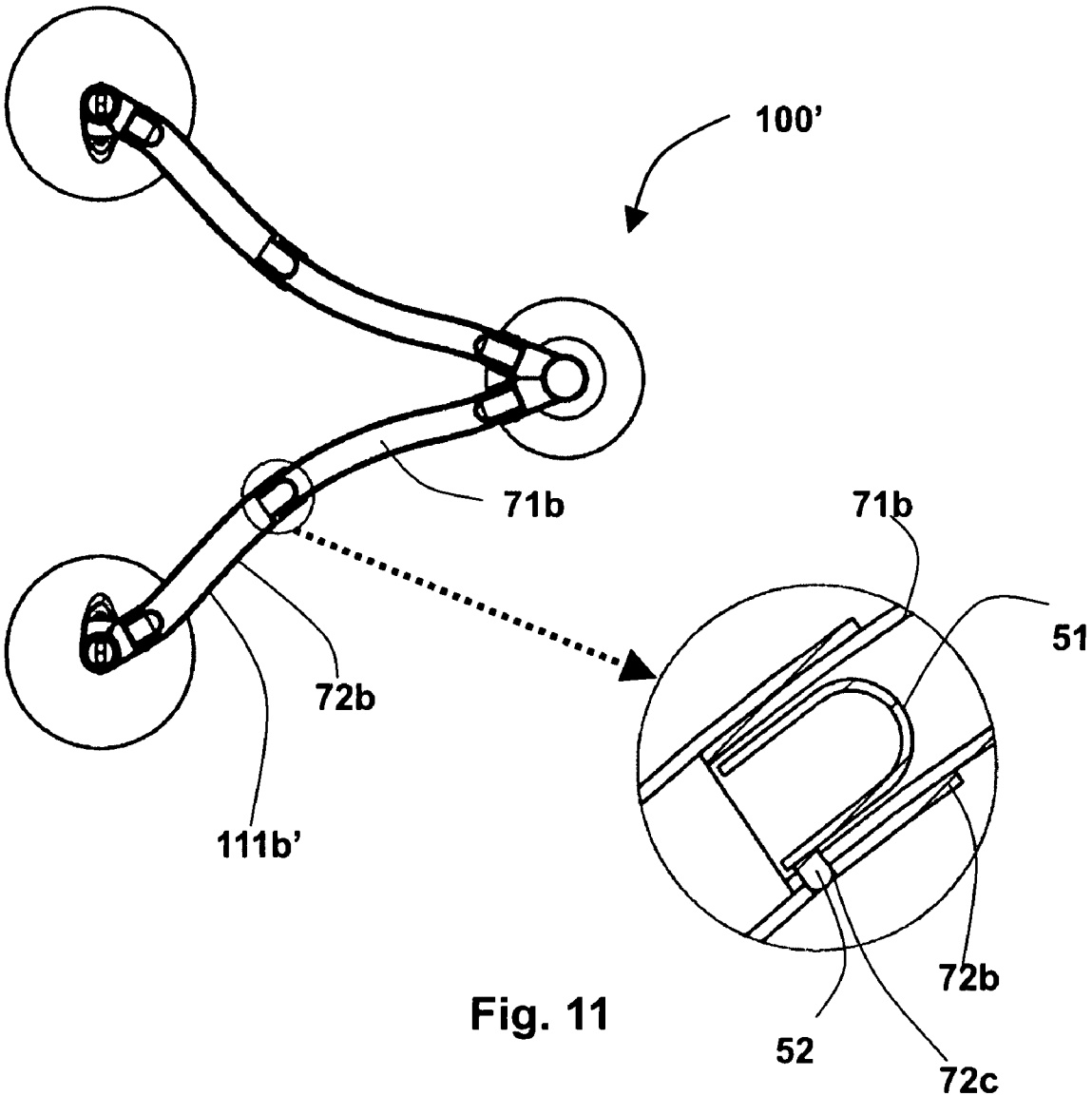
FIG. 11 is a schematic illustration of a fastening mechanism for fastening adjustable telescopic parts of a chassis member of the adjustable ergonomic supporting body of the ergonomic pedaling apparatus, according to the embodiments illustrated in FIG. 10.

FIGS. 10-11 schematically illustrate an adjustable ergonomic pedaling apparatus 100', according to other embodiments of the invention. According to these embodiments, adjustable ergonomic pedaling apparatus 100' comprises:

ergonomic supporting body 110' having a triangular chassis constructed from three adjustable chassis members 111*a*, 111*b*' and 111*c'*;

first, second and third floatation units 120*a*', 120*b*' and 120*c*', where the back first and second floatation units 120*a*' and 120*b*' include one float each and third floatation unit 120*c*' include two float parts having the same floatation proportions as that of ergonomic pedaling apparatus 100 described above; and a pedaling assembly 130' including two front ergonomic scooped pedals 131*a*' and 131*b'*.

All components of adjustable ergonomic pedaling apparatus 100' are modularly connected and configured in a similar manner to that of apparatus 100, only in these embodiments, chassis members 111*a*, 111*b*' and 111*c*' are adjustable enabling any user to adjust the length of chassis members 111*a*, 111*b*' and 111*c*' and thereby adjust the size of the chassis of ergonomic supporting body 110'.

Each chassis member may be telescopic, constructed of member parts such as parts 71*a*, 72*a*, 71*b*, 72*b*, 71*c*, and 72*c*, of chassis members 111*a*', 111*b*' and 111*c*', respectively which can coaxially slide in one another to allow adjustment of the chassis member's length. Fastening mechanisms may enable securing the parts to one another once the desired length is determined. Determining the length of a chassis member may be carried out by simply sliding one member part in or out of the other, as known in the art.

The fastening mechanism enabling to secure the desired adjusted length of chassis member 111*b*' may be similar to fastening means described, where one of the parts includes the hidden member at the edge(s) that are to be inserted into the other part(s) with the protrusion and the other part includes holes to enable securing the adjusted length by receiving the protrusion.

For example, as illustrated in FIG. 11, chassis member 111*b*' includes two parts 71*b* and 72*b* where part 71*b* is inserted in part 72*b*. Inserted part 71*b* includes hidden member 51 and protrusion 52, where part 72*b* includes holes 72*c* enabling to receive the protrusion and thereby secure the positioning of the parts in relation to one another.

Although various features of the invention may be described in the context of a single embodiment, the features may also be provided separately or in any suitable combination. Conversely, although the invention may be described herein in the context of separate embodiments for clarity, the invention may also be implemented in a single embodiment.

While the invention has been described with respect to a limited number of embodiments, these should not be construed as limitations on the scope of the invention, but rather as exemplifications of some of the embodiments thereof, including a preferred embodiment. The scope of the invention should not be limited by what has been described, but by the appended claims and their legal equivalents.

What is claimed is:

1. An ergonomic pedaling apparatus for travel in water, enabling a user to practice swimming skills, said ergonomic pedaling apparatus comprising:

an ergonomic supporting body having a curved triangular structure creating three vertices, wherein said triangular structure includes a curved triangular chassis constructed by three connected chassis members, wherein said supporting body enables supporting the user's upper body part when frontally mounted over said chassis;

three floatation units each connected to a separate vertex of said body; and a pedaling assembly comprising two scooped ergonomic pedals enabling the user to progress in the water by pedaling said pedals, where the scooped shape of each pedal enables scooping water in an opposite direction to a direction of travel, wherein said three floatation units include: a first and a second back floatation units each comprising a float, wherein the floatability of the back floatation units is substantially equal and a third front floatation unit comprising two float parts vertically positioned one on top of the other, wherein the distances between the two back floatation units and the third floatation unit are designed to allow the user to place an abdominal part of the user's body between the back floatation units, where a head of the user is positioned above the third floatation unit, wherein said pedaling assembly is located underneath the third floatation unit for allowing hand pedaling of the apparatus, and wherein the floatability of the combined floats of the third floatation unit is substantially equal to the floatability of each of the back floatation units.

2. The ergonomic pedaling apparatus of claim 1, further comprising:

a first angular removable connector and a second removable connector having outlets enabling to connect one of said chassis members to the floats of the back floatation units and each of the back floatation units to one of the floats of said third floatation unit by receiving each end of said chassis members in each outlet;

a third angular removable connector having at least three outlets enabling to receive two of said chassis members at two of said outlets to connect to the back floatation units;

an elongated member enabling to connect to a first float part of the third floatation unit through the third outlet of said third angular removable connector at one end of said elongated member and to a second float part of said third floatation unit at another end; and pedals connecting mechanism enabling to connect said scooped pedals to said second float of said third floatation unit, wherein the pedaling assembly includes said pedals and said pedals connecting mechanism;

wherein said removable angular connectors connecting said chassis members to said floatation units enable forming the triangular ergonomic structure of the supporting body while connecting at least some of the floats of the floatation units in a removable manner, providing a modular ergonomic pedaling apparatus enabling to define the size of the supporting body and the floatability of each of the floats in the floatation units according to a desired configuration by enabling to replace the chassis members and the floats.

3. The ergonomic pedaling apparatus of claim 2, wherein said pedals connecting mechanism comprises:

said second float part, wherein said second float part is a hollow tube shaped float;

two pedal connectors enabling to removably connect to one another where the connected pedal connectors are removably and rotatably inserted through the hollow tube of said second float part, wherein each of said scooped pedals is connected to one of said pedal connectors.

4. The ergonomic pedaling apparatus of claim 3, wherein each scooped pedal includes a perforation through which the pedal connector end is inserted.

5. The ergonomic pedaling apparatus of claim 4, further comprising fastening caps each of the floats of said back first and second floatation units and the first float of the third floatation unit include a perforation enabling to insert the outlet of the angular connector through said perforation and covering said outlet using said fastening cap, wherein said fastening cap is fasten to said angular connector through a fastening mechanism.

6. The ergonomic pedaling apparatus of claim 5, wherein said angular connectors are removably fastened to said fastening caps.

7. The ergonomic pedaling apparatus of claim 3, wherein said two pedal connectors are connected to one another, wherein one end of one of said pedal connectors includes at least one hole and one end of the other pedal connector includes a hidden member and a protrusion.

8. The ergonomic pedaling apparatus of claim 7, wherein at least one of said chassis members is adjustable including a telescopic adjustment mechanism enabling to adjust the length of each chassis member and thereby the size of the ergonomic supporting body.

9. The ergonomic pedaling apparatus of claim 8, wherein each said chassis member comprises at least two parts coaxially and slidably inserted into one another, wherein once the positioning of one part in relation to the other part is adjusted a fastening mechanism, enables securing the adjusted position by fastening one part to the other.

10. The ergonomic pedaling apparatus of claim 2, wherein each of the first and the second back floatation units comprises one float.

11. The ergonomic pedaling apparatus of claim 10, wherein each of the floats of the first and second back floatation units is located along an axis, which is substantially perpendicular to an axis connecting the float parts of the third floatation unit.

12. The ergonomic pedaling apparatus of claim 10, wherein each of the floats of the first and second back floatation units has radial symmetry in relation to an axis perpendicular to the axis that passes between said floats.

13. An ergonomic pedaling apparatus for travel in water, enabling a user to practice swimming skills, said ergonomic pedaling apparatus comprising:

an ergonomic supporting body having a curved triangular structure creating three vertices, wherein said triangular structure includes:

a curved triangular chassis constructed by three connected chassis members, wherein said supporting body enables supporting the upper part of the user's body when frontally mounted over said chassis;

a first angular removable connector and a second removable connector having at least two outlets enabling to connect one of said chassis members to floats of two back floatation units and each of the two back floatation units to one of the floats of a third floatation unit by receiving each end of said chassis members in each outlet; and a third angular removable connector having at least three outlets enabling to receive two of said chassis members at two of said outlets to connect to the back floatation units;

the two back floatation units and the third floatation unit constituting three floatation units each connected to a separate vertex of said body, the two back floatation units each comprising one float of the same shape size and floatability and a third front floatation unit comprising two floats vertically connected to one another;

a pedaling assembly comprising two scooped ergonomic pedals enabling the user to progress in the water by pedaling said pedals, where the scooped shape of each pedal enables scooping water in an opposite direction to the direction of travel;

an elongated member enabling to connect to a first float of the third floatation unit through the third outlet of said third angular removable connector at one end of said elongated member and to a second float of said third floatation unit at another end; and pedals connecting mechanism enabling to connect said scooped pedals to said second float of said third floatation unit;

wherein said removable connectors connecting said chassis members to said floatation units enable forming the triangular ergonomic structure of the supporting body while connecting at least some of the floats of the floatation units in a removable manner, creating a modular ergonomic pedaling apparatus enabling to define the size of the supporting body and the floatability of each of the floats in the floatation units according to a desired configuration by enabling to replace the chassis members and the floats, wherein the floatability of the back floatation units is substantially equal, wherein the distances between the two back floatation units and the third floatation unit are designed to allow the user to place the abdominal part of the user's body between the back floatation units, where the head of the user is positioned above the third floatation unit, wherein said pedaling assembly is located underneath the third floatation unit for allowing hand pedaling of the apparatus, and wherein the floatability of the combined two floats of the third floatation unit is substantially equal to the floatability of each of the back floatation units.

14. An ergonomic pedaling apparatus for travel in water, enabling a user to practice swimming skills, said ergonomic pedaling apparatus comprising:

an ergonomic supporting body having a curved triangular structure creating three vertices, wherein said triangular structure includes a curved triangular chassis constructed by three connected chassis members, wherein said supporting body enables supporting the user's upper body part when frontally mounted over said chassis;

three floatation units connected to the three vertices of said body; and a pedaling assembly comprising two scooped ergonomic pedals enabling the user to progress in the water by pedaling said pedals, where the scooped shape of each pedal enables scooping water in an opposite direction to a direction of travel, wherein said three floatation units include a first back floatation unit, a second back floatation unit and a third front floatation unit, each of the three floatation units having a float, wherein the distances between the two back floatation units and the third floatation unit are designed to allow the user to place an abdominal part of the user's body between the back floatation units, where a head of the user is positioned above the third floatation unit, wherein said pedaling assembly is located underneath the third floatation unit for allowing hand pedaling of the apparatus.

15. The ergonomic pedaling apparatus of claim 14, wherein the third front floatation unit comprises two float parts.

16. The ergonomic pedaling apparatus of claim 15, wherein the two float parts are vertically positioned one on top of the other.

17. The ergonomic pedaling apparatus of claim 14, wherein the floatability of the first and second back floatation units are substantially equal.

* * * * *